US005235792A

United States Patent [19]

Hanagata

[11] Patent Number: 5,235,792

[45] Date of Patent: Aug. 17, 1993

[54] CONTINUOUS PACKAGING MACHINE WITH PREFOLDED FILM

[75] Inventor: Toshiyuki Hanagata, Toyama, Japan

[73] Assignee: Hanagata Corporation, Tokyo, Japan

[21] Appl. No.: 960,501

[22] Filed: Oct. 13, 1992

[30] Foreign Application Priority Data

Mar. 31, 1992 [JP] Japan ..... 4-76667

[51] Int. Cl.[5] ..... B65B 61/00; B65B 41/16; B65B 9/08

[52] U.S. Cl. ..... 53/141; 53/568; 53/389.1

[58] Field of Search ..... 53/550, 551, 568, 141, 53/450, 451, 554, 555, 389.1

[56] References Cited

U.S. PATENT DOCUMENTS

| | | | |
|---|---|---|---|
| 3,364,650 | 1/1968 | House | 53/568 |
| 3,462,909 | 8/1969 | Anderson | 53/141 X |
| 4,035,984 | 7/1977 | Gerlach et al. | 53/450 |
| 4,419,855 | 12/1983 | Shanklin | 53/550 X |
| 4,516,385 | 5/1985 | Lenker et al. | 53/550 X |
| 4,879,863 | 11/1989 | DiBernardo | 53/568 X |

*Primary Examiner*—Horace M. Culver
*Attorney, Agent, or Firm*—Hill, Steadman & Simpson

[57] ABSTRACT

The blocking troubles due to the static electricity can be completely removed in the opening of the prefolded film. In a continuous packaging machine according to this invention; A web of a synthetic resin packaging material prefolded along the longitudinal direction thereof is fed under a predetermined tension through one or more guide rollers into a film opening mechanism. The prefolded film is opened in the film opening mechanism and is simultaneously inverted and formed into a substantially lateral U-shaped cross section. After package articles are successively transferred into the opened inner parts of the lateral U-shaped synthetic resin packaging film, the opening of the synthetic resin packaging film in the periphery of the package articles is automatically sealed in the automatic sealing section. In accordance with the inventive structure of the continuous packaging machine, an electrostatic removing means is disposed between one or more guide rollers and the film opening mechanim is set between the adjacent inner surfaces of the prefolded synthetic resin packaging film.

6 Claims, 5 Drawing Sheets

CONTINUOUS PACKAGING MACHINE WITH PREFOLDED FILM

BACKGROUND OF THE INVENTION

1. Field of the Invention

This invention relates to a continuous packaging machine for successively packaging articles to be packaged by use of a web of a longitudinally prefolded film made of a synthetic resin sheet or synthetic resin laminated sheet, and more particularly to a continuous packaging machine in which a prefolded and firmly contacted film may be easily opened.

2. Prior Art

In the conventional art, a continuous automatic packaging machine is proposed as disclosed for example in JP, A sho 47-29087 (Japanese Patent Publication of Unexamined Application) that a guide board of a generally isosceles triangle is disposed to contact with the upper surface of a packaging film which is continuously drawn out horizontally from a winded roll, the packaging film is led from the two sides of the guide board to a generally vertical direction and after it is continuously prefolded through a guide roller, the prefolded film is opened and inverted to change the feed direction thereof, and after package articles are successively inserted into the opening of the prefolded film, the opening thereof is automatically sealed along the periphery of the package articles.

The prefolded film opening mechanism has however not been used as disclosed for example in U.S. Pat. No. 3,583,888 (1971), since it has been difficult to insert the package articles into the opening of the prefolded film by means of a simple device. In recent years, an automatic packaging machine is proposed and used for example in Japanese Utility Model sho 60-20567, that a web of a prefolded and rolledly winded film is continuously drawnout and opened through a film opening device while the prefolded film is inverted, a thin belt conveyor is disposed in the film opening device, and after package articles are intermittently introduced into the prefolded and opened film, the opening of the prefolded film is sealed by means of a L-shaped sealer. This means that since a considerably devised thin belt conveyor is inserted into the opening of the prefolded film, the package articles may be easily and precisely inserted into the opening of the prefolded film.

Many films of various qualities and structures are produced in the recent years and used as the packaging materials. There are various films, for example thick film such as an air cap, a laminated film, an adhesive film and the like.

However, after these films are prefolded and winded to provide a roll, when these prefolded films are opened while being drawnout, the static electricity generated between the adjacent surfaces of the prefolded film by the contact friction with guide rollers in winding and feeding, so that the blocking between the adjacent surfaces of the prefolded film due to the static electricity becomes hard to disturb the smooth opening of the prefolded film.

Accordingly, in order to remove these electrostatic troubles, an electrostatic charge preventing agent has been added to the film in manufacturing of the conventional film. However, in packaging of foods, the electrostatic charge preventing agent added to film is unfavourable by reason of health. Hence, the electrostatic charge removing means is directly connected to guide rollers for perfolded film. In this electrostatic charge removing means, it is also an actual practice that expectant results can not be obtained in case of the prefolded film. In order to dissolve the inconveniences due to the generation of this static electricity, it is required to remove blocking of the packaging material such as the prefolded film before opening thereof, so as to be able to carry out the continuous automation.

SUMMARY OF THE INVENTION

It is therefore an object of this invention to provide an electrostatic charge removing means whereby static electricity can be completely removed from a packaging material such as a prefolded synthetic resin film in the film opening step before supplying package articles in a continuous packaging machine for packaging the articles by use of the prefolded packaging material.

These problems are investigated from some standpoints and it is discovered that since it is considerably difficult to remove the static electricity between the two-folded films from the external surfaces thereof, an electrostatic charge removing means is set between the internal surfaces of the prefolded film to remove the static electricity from the firmly contacted film completely.

This invention is characterized in that a continuous packaging machine for successively packaging package articles with a web of a longitudinally prefolded film made of synthetic resin, including a feed means for feeding said prefolded synthetic resin film under a predetermined tension through one or more guide rollers into a film opening mechanism, said film opening mechanism opening said prefolded synthetic resin film simultaneously to invert it and to form a generally lateral U-shaped cross section, a transfer means transferring said package articles into the opened inner parts of said lateral U-shaped synthetic resin film successively, and a sealing section sealing the opening of said synthetic resin film along the periphery of said articles automatically. And this invention is also characterized in that the continuous packaging machine comprises an electrostatic charge removing means which is disposed between said one or more rollers and said film opening mechanism to be set between the adjacent inner surfaces of said prefolded synthetic resin film.

As a favourable form, the electrostatic charge removing means is disposed between two guide rollers adjacent to the film opening mechanism. The electrostatic charge removing means comprises a metal plate member of which a part is connected to the earth end, and a synthetic resin brush. The electrostatic charge removing means is set orthogonal to the prefolded synthetic resin packaging material feeding path. The metal plate member is made of a piece of metal plate and bent to form a generally wedge cross section. The acute tip of the metal plate member is arranged to face the upstream side of the feeding path. One longitudinal end of the synthetic resin brush is held and fixed between both ends of the metal plate of wedge cross section to provide a slight clearance between the brush and the internal surfaces of the synthetic resin packaging material. Moreover, in this invention, a synthetic resin membrane may be used instead of the brush. For example, the synthetic resin coating formed along the edge side of the acute tip of the metal plate member or the synthetic resin membrane adhere along the edge side of the metal plate can be used instead.

The prefolded film is opened by the back part of the metal piece of the electrostatic charge removing means. The static electricity charged in the prefolded film escapes from a synthetic resin brush exposed from the tip of the metal piece or from a synthetic resin membrane through the metal piece and a frame into a ground. Before the prefolded film reaches to a film opening mechanism, the static electricity is completely removed from the prefolded film, so that the film opening can be easily carried out. In this film opening mechanism, the prefolded film is smoothly turned over through inclined portions of upper and lower frames from upper side of upper frame and lower side of lower frame into insides thereof to provide a lateral U-shaped cross section.

According to the continuous packaging machine of this invention, since an electrostatic charge removing means is inserted and set in the inner part of a prefolded film immediately before a film opening means, various troubles caused by the static electricity are certainly eliminated, and since an adhesion between upper and lower surfaces of a prefolded film can be prevented in a feed direction changing portion to introduce the prefolded film into the film opening means of the following process smoothly, the prefolded film is easily opened to prevent the losses and the stop on the way of a machine operation so as to improve productivity considerably.

Other objects of this invention will be obvious upon an understanding of the illustrative embodiments about to be described or will be indicated in the appended claims, and various advantages not referred to herein will occur to one skilled in the art upon employment of the invention in practice.

DETAILED DESCRIPTION

Embodiments of this invention will be described with reference to the accompanying drawings.

An automatic packaging apparatus which is disclosed for example in Japanese Utility Model sho 60-20567, is simply illustrated with reference to FIG. 1 to FIG. 3 and shall be better understood from the above-mentioned Japanese Utility Model.

Figure 1:
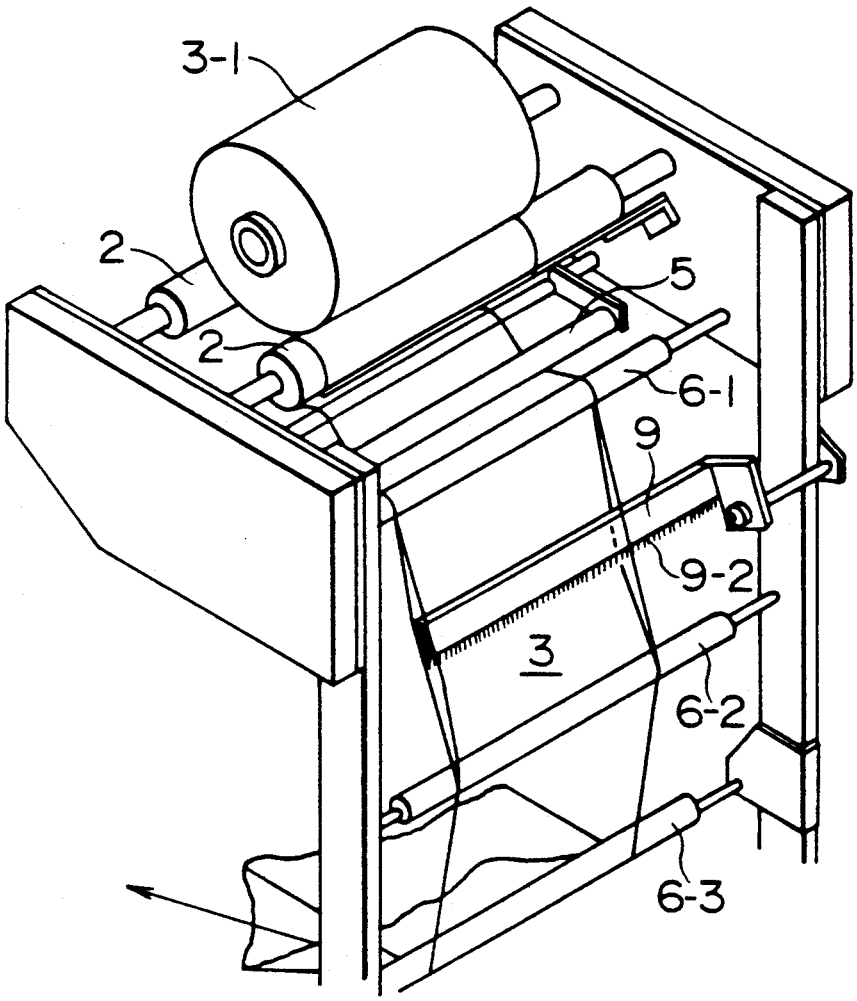
FIG. 1 is a perspective view for showing an important part of a typical embodiment of a continuous packaging machine according to this invention.
Figure 2:
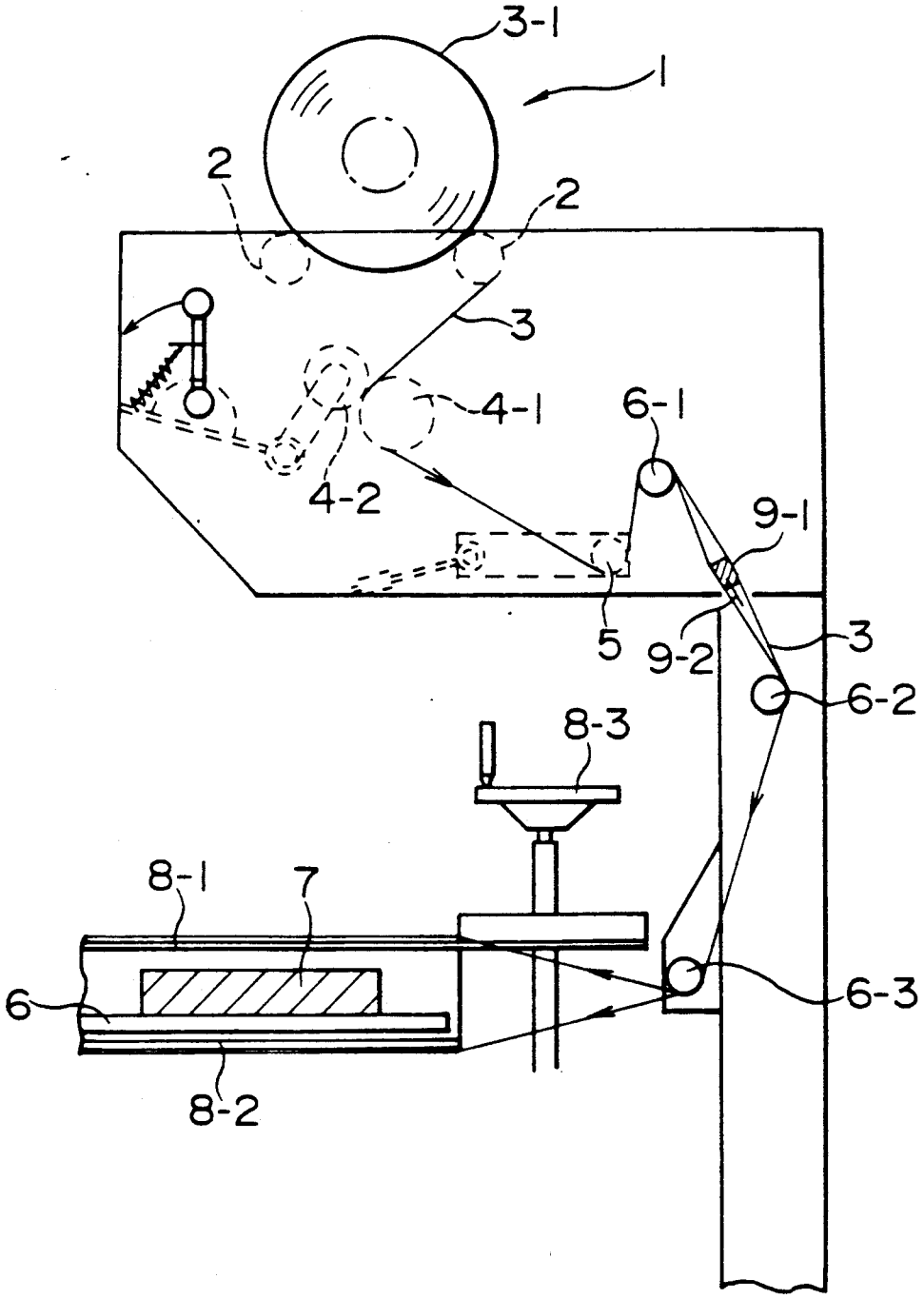
FIG. 2 is a side view for showing the important part of the continuous packaging machine.
Figure 3:
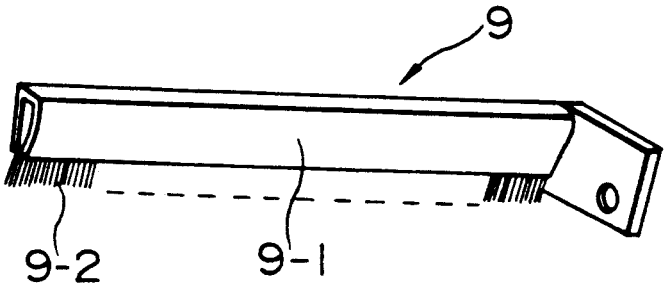
FIG. 3 is an enlarged perspective view of an electrostatic charge removing means which is disposed in the continuous packaging machine.

In FIG. 1 to FIG. 3, a feeding section of a prefolded film 3 is indicated by numeral 1. A web of film is prefolded in the longitudinal direction thereof to provide a two sides prefolded film 3. The prefolded film 3 is winded-up to provide a roll film 3-1 which is put on two feeding rollers 2. A film feeding shaft 4-2 is disposed in the lower part of the roll film 3-1 which is put on the feeding rollers 2. The prefolded film 3 is passed between a film pressing shaft 4-1 and the film feeding shaft 4-2. While the film is maintained under a predetermined tension by means of a tension roller 5, it is introduced through plural guide rollers into a film opening means 8 which is disposed in the feeding section 1 of a package article.

In this embodiment, three guide rollers are disposed in a continuous packaging machine, and an electrostatic charge removing means of an important element of this invention is disposed in the middle position between a first guide roller 6-1 and a second guide roller 6-2. A third guide roller 6-3 is a direction changing roller for changing over the feeding direction of the prefolded film 3 about 90 degrees toward the film opening means 8.

As shown in the drawings, an electrostatic charge removing means comprises a metal plate and a synthetic resin brush. That is, the electrostatic charge removing means 9 according to this embodiment comprises a piece of metal plate 9-1 which is bent at an acute angle in the longitudinal direction thereof into two parts, of which the tip is further bent toward its inside to provide an engagement of a wedge type cross section, and a brush 9-2 which is made of a synthetic resin material such as a polyester and the like, of which one end is gripped and held with the engagement of the metal piece 9-1. Then, the electrostatic charge removing means 9 is a plate type member having a whole length longer than the width of the prefolded film 3. This electrostatic charge removing means 9 is disposed orthogonal to a film feeding path and set in a middle position between a first guide roller 6-1 and a second guide roller 6-2, as shown in FIG. 1 and FIG. 2. The metal piece 9-1 is arranged in the upstream side of the film and the brush 9-2 is faced toward the downstream side thereof.

Figure 4:
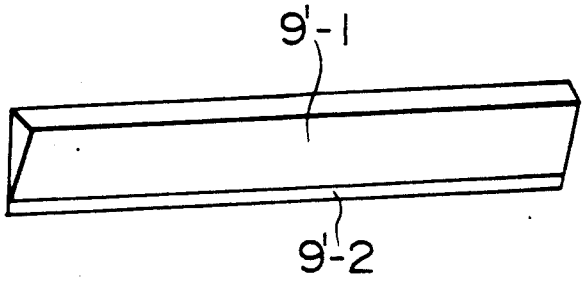
FIG. 4 is an enlarged perspective view of an other electrostatic charge removing means which is disposed in the continuous packaging machine.
Figure 5:
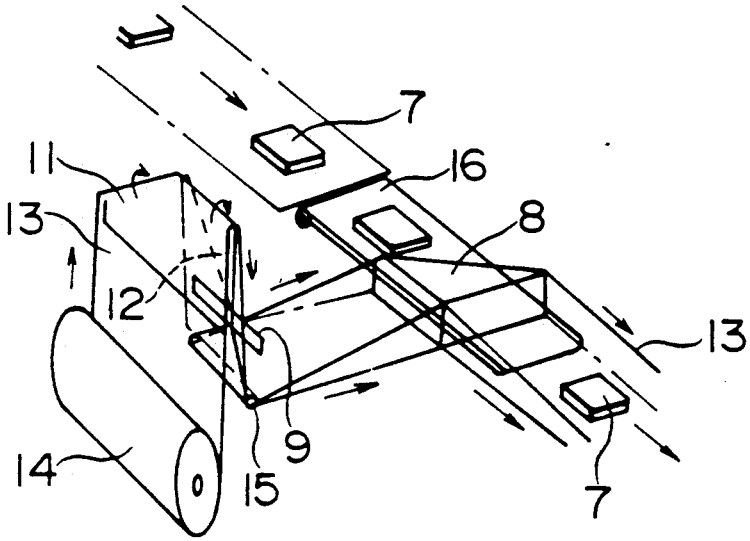
FIG. 5 is a whole view of the continuous packaging machine which shows an other embodiment of this invention.

In this embodiment, the metal piece 9-1 is formed into a generally wedge type cross section by the bending process, but also two metal pieces may be welded to be integrally formed into the wedge cross section. As shown in FIG. 4, a synthetic resin coating film 9'-2 formed onto an acute tip surface of the wedge type metal piece 9'-1 or a synthetic resin membrane attached to the acute tip portion of the metal piece 9'-1 by a proper means can be used instead of the synthetic resin brush 9-2.

The film opening means 8 is composed of two right-angled isosceles triangle frames 8-1, 8-2, in which one side of said triangle frames orthogonal to the feeding direction of the prefolded film 3 is set at the right angle with the other side of said triangle frames orthogonal to the transferring path on the downstream side of package articles 7. Then, the two frames 8-1, 8-2 are disposed in parallel up and down with a desired space. By operation of a handle 8-3, the upper frame 8-1 is moved up and down to regulate the interval between the upper and lower frames 8-1 and 8-2.

The prefolded film 3 which is drawn from a film roll 3-1 is opened by the back part of the metal piece 9-1 of the electrostatic charge removing means 9. Then, the static electricity present on the internal surfaces of the prefolded film 3 escapes from said prefolded film 3 through the synthetic resin brush 9-2 held between the engaging parts of the metal piece 9-1 and though the mental piece 9-1 and the frame to the ground. Since the static electricity is completely removed from the film 3 before the film 3 reaches to the film opening means 8, the film opening can be easily carried out. In this film opening means 8, the prefolded film 3 is smoothly inverted along the inclined portions of the upper and lower frames 8-1 and 8-2 from the upper and lower sides to the internal side to provide a laternal U-shaped cross section. The feeding direction is changed-over by 90 degrees to supply the prefolded film 3 in the same direction to the transferring direction of the package articles 7.

A belt conveyor is inserted in the film opening means 8 along the transfer direction of the package articles 7 penetrating the inner part of the opening means. The package articles 7 are successively passed through the film opening means 8 by means of the belt conveyor to be inserted in the inner part of the prefolded film 3 having a generally lateral U-shaped cross section. After the package article 7 is inserted into the prefolded film 3, the film opening arranged on the periphery of the article 7 is sealed by means of a L-type sealer (not shown in the drawings) to package the article 7.

Figure 6:
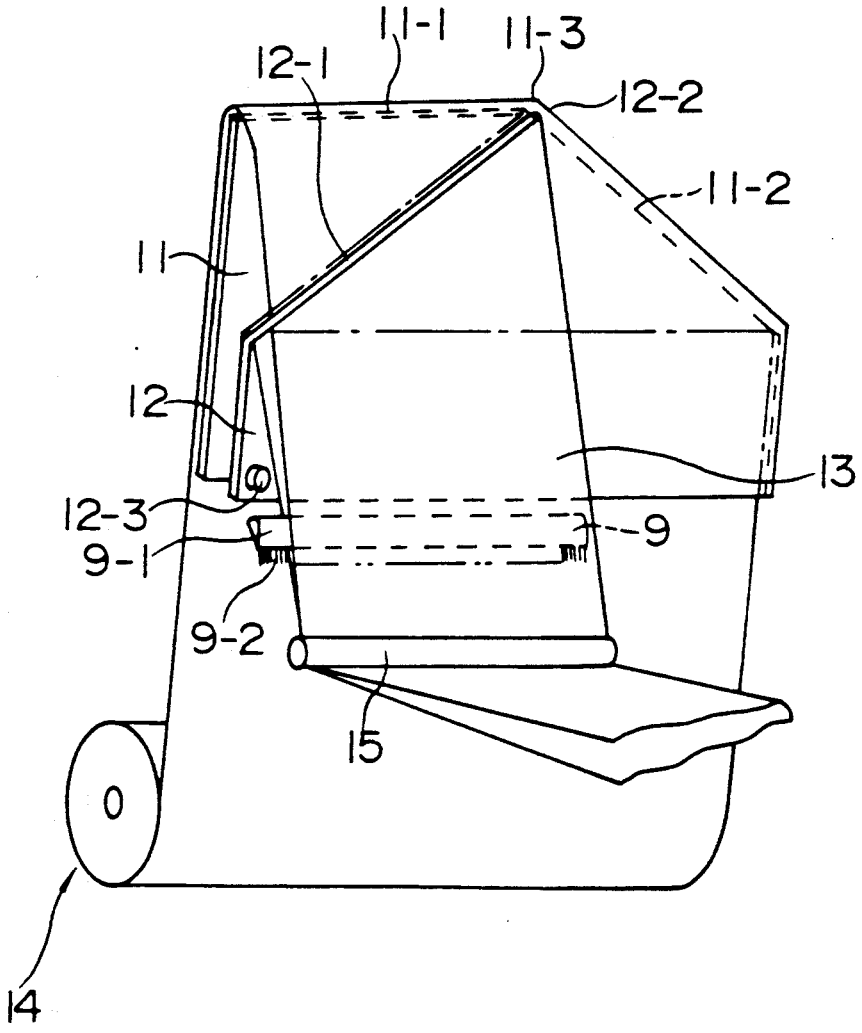
FIG. 6 is a construction view for showing a film prefolding means of the continuous packaging machine.
Figure 7:
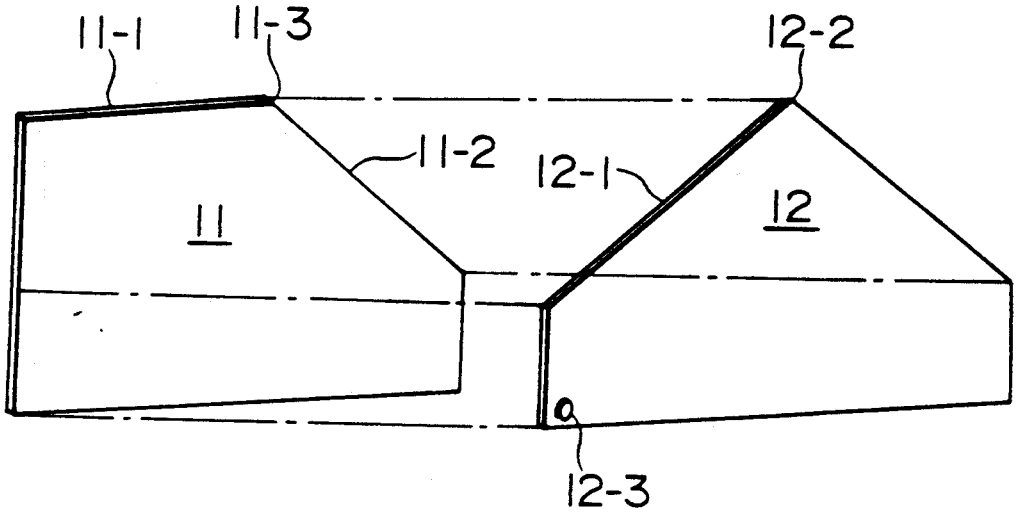
FIG. 7 is a perspective view for showing individual forms of first and second guide members of the prefolding means.

In FIG. 5 to FIG. 8, an other embodiment of the continuous packaging machine according to this invention is shown that a sheet of film is longitudinally prefolded in a film prefolding means 10 which is connected to the film opening means 8. The film prefolding means 10 comprises primarily first and second guide members which are respectively indicated generally by numerals 11 and 12. The first guide member 11 is composed of a trapezoid board including a horizontal guide portion 11-1 having a length equal to about half of the width of the film and an inclined guide portion 11-2 having a length same as that of the horizontal guide portion 11-1, wherein the horizontal guide portion is connected to the inclined guide portion which is inclined at about 45 degrees, as shown in FIG. 6. The second guide member 12 is composed of a right-angled isosceles triangle board, as shown in FIG. 7. Then, the second guide member 12 has one side of the isosceles shape which is an inclined guide portion 12-1 substantially and the other side thereof which does not function directly as the guide member.

Thus, the first and second guide members 11 and 12 are disposed parallel and adjacent to each other to face a bending point 11-3 between the horizontal guide portion 11-1 and the inclined guide portion 11-2 of the first guide member 11 against a vertex 12-2 of the right angle of the second guide member 12. A front face of the first guide member 11 is arranged parallel and to be adjacent and opposed to a back face of the second guide member 12. As shown in FIG. 6, the flat faces of the first and second guide members 11 and 12 stand upright and are secured to the frame. The inclined guide portion 12-1 of the second guide member 12 is rotated about a lower end shaft 12-3 in the upward and downward direction. The rotating scope is favourable as far as it is within the scope of the rotating angle from a position that the vertex 12-2 is opposed to the bending point 11-3 to about 45 degrees downwardly, which is however not limited in this invention.

A wind roll 14 of winded wide film 13 is disposed immediately under the back side of the standing first guide member 11 so that an axis of the roll 14 is arranged to be parallel with the horizontal guide portion 11-1. A guide roller 15 is disposed under the front side of the second guide member 12 in parallel with the wind roll 14. A prefolded film 3 which is prefolded by means of the first guide member 11 and second guide member 12, proceeds, along the lower periphery of the guide roller 15 to change-over the running direction thereof from the vertical direction to the horizontal direction.

In the middle point between the first and second guide members 11, 12 and the guide roller 15, the electrostatic charge removing means 9 which is an important part of this invention, is disposed orthogonal to the film feeding path to arrange a metal piece 9-1 in the film upstream side and a brush 9-2 in the film downstream side and is secured to a frame which is not shown in the drawings.

In the above-mentioned structure, the prefolding mechanism of the film 13 is also illustrated with reference to FIG. 8 which shows schematically a process for prefolding the film 13, but the illustration of the first and second guide members 11 and 12 is omitted herein for the convenience.

Figure 8:
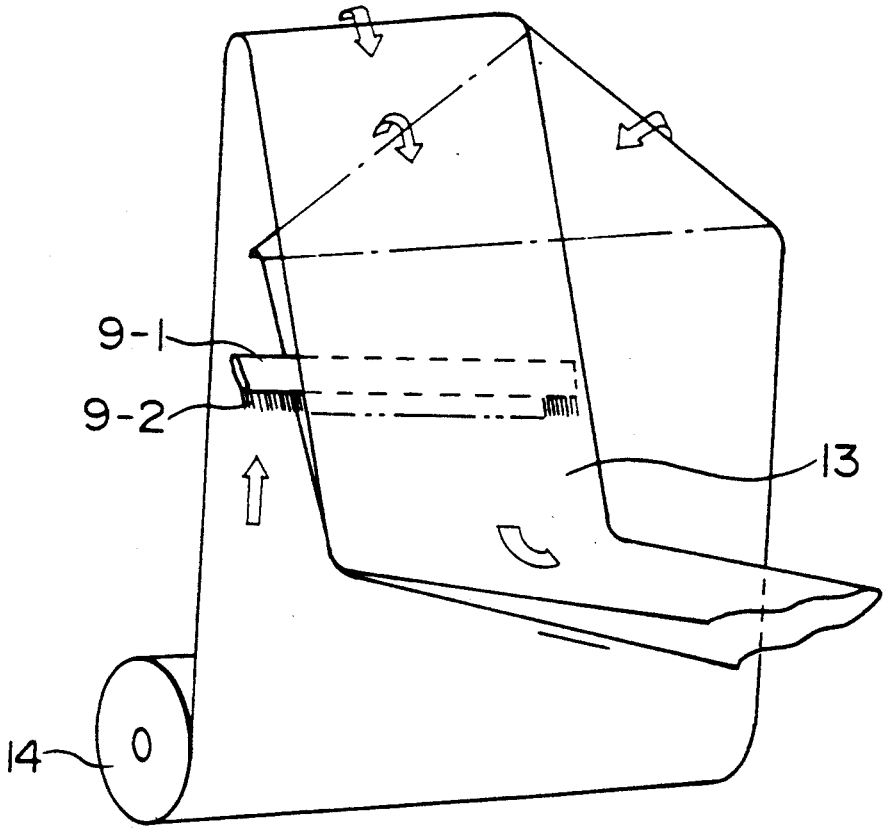
FIG. 8 is an illustrative view for showing a film prefolded by the half-folding or prefolding means.

In FIG. 7 and FIG. 8, in order to set the film 13 drawn from the wind roll 14 on individual guide members 11 and 12, the second guide member 12 is prerotated about the shaft 12-3 downwardly to draw up the film 13 along the back side of the first guide member 11 so as to fold the film forwardly along the inclined guide portion 11-2 of the guide member 11 and along 11 and along the horizontal guide portion 11-1 thereof. By thus folding operation, the film 13 is folded along the longitudinal direction at the bending point 11-3 as shown in FIG. 6. Then, the second guide member 12 is rotated upwardly about the shaft 12-3 to return the vertex 12-2 of the guide member 12 to the position opposed to the bending point 11-3 of the first guide member 11. By this rotation, the second guide member 12 is rotated and inserted between a front face and back face of two films 13-1, 13-2 which are folded from a wide film 13 along the inclined guide portion 11-2 of the first member 11. If this rotation is not carried-out, the introduction of the film 13 from the first guide member 11 to the second member 12 becomes complicated and the working efficiency will be reduced.

While the film 13 is introduced from the first guide member 11 to the second guide member 12, it is folded into halves and moved downwardly. Before the half-folded or prefolded film 13 reaches to the guide roller 15, the electrostatic, charge removing means 9 is inserted into the inner part of the prefolded film 13. Then, the static electricity charged in the film is completely removed and the upper and lower films 13-1 and 13-2 of the prefolded film 13 are separated completely, so that when the transfer direction of the film 13 is changed-over, the upper and lower films 13-1 and 13-2 of the film 13 are not contacted with each other, and the prefolded film 13 is changed-over from the vertical direction to the horizontal direction to be introduced into an automatic packaging apparatus in the following process smoothly.

In the above-mentioned embodiment, the first and second guide members 11 and 12 are commonly formed as the board members, however they may be formed as for example a rod member, a roller, and the like independently or combinedly. The second guide member 12 may be made of only the inclined guide portion 12-1 to eliminate other extra portions. In respect of the rotation direction of the second guide member 12, it is not only rotated in the vertical direction but also it may be rotated in the horizontal direction.

While preferred embodiments of the continuous packaging machine according to this invention have been described using specific terms, such description is for illustrative purpose only, and it is to be understood that changes and variations may be made without departing from the spirit or scope of the following claims.

What is claimed is:

1. A continuous packaging machine for successively packaging package articles with a web of a longitudinally prefolded film made of a synthetic resin including a feed means for feeding said prefolded synthetic resin film under a predetermined tension through one or more guide rollers into a film opening mechanism, said film opening mechanism for opening said prefolded synthetic resin film simultaneously to invert it and to form a generally lateral U-shaped cross section, a transfer means for successively transferring said package articles into the opened inner parts of said lateral U-shaped synthetic resin film, and a sealing section for automatically sealing the opening of said synthetic resin film along the periphery of said article; the continuous packaging machine comprising an electrostatic charge removing means which is disposed between said one or more rollers and said film opening mechanism to be set between the adjacent inner surfaces of said prefolded synthetic resin packaging film.

2. A continuous packaging machine as defined in claim 1, wherein said electrostatic charge removing means is disposed between two guide rollers which are arranged adjacent to said film opening mechanism.

3. A continuous packaging machine as defined in claim 1 or claim 2, wherein said electrostatic charge removing means comprises a metal plate member of which a part is connected to an earth and a synthetic resin brush, said electrostatic charge removing means being disposed orthogonal to the feed path of said prefolded synthetic resin packaging film.

4. A continuous packaging machine as defined in claim 3, wherein said metal plate member is composed of a metal of a substantially wedge cross section, a tip of said metal plate being faced toward the upstream side of said feed path of the synthetic resin packaging film.

5. A continuous packaging machine as defined in claim 4, wherein one longitudinal end of said synthetic resin brush is secured to said tip portion of said metal plate of the wedge cross section so as to provide a slight clearance between said brush and the inner surfaces of said prefolded synthetic resin packaging film.

6. A continuous packaging machine as defined in claim 4, wherein a synthetic resin membrane is disposed along the edge side of said tip portion of said metal plate having said wedge cross section, to provide a slight clearance between said synthetic resin membrane and the inner surfaces said prefolded synthetic resin packaging film.

* * * * *